United States Patent [19]

Proctor

[11] 4,093,928

[45] June 6, 1978

[54] MICROSTRIP HYBRID RING COUPLER

[75] Inventor: David Proctor, San Diego, Calif.

[73] Assignee: The United States of America as represented by the Secretary of the Navy, Washington, D.C.

[21] Appl. No.: 752,646

[22] Filed: Dec. 20, 1976

[51] Int. Cl.[2] ..... H01P 5/22

[52] U.S. Cl. ..... 333/11; 333/31 R

[58] Field of Search ..... 333/11, 84 M

[56] References Cited

U.S. PATENT DOCUMENTS

| | | | |
|---|---|---|---|
| 3,562,674 | 2/1971 | Gerst | 333/31 X |
| 4,023,123 | 5/1977 | Reindel | 333/11 |

FOREIGN PATENT DOCUMENTS

| | | | |
|---|---|---|---|
| 7,661 | 3/1972 | Japan | 333/11 |
| 1,183,343 | 3/1970 | United Kingdom | 333/11 |

*Primary Examiner*—Paul L. Gensler

*Attorney, Agent, or Firm*—R. S. Sciascia; G. J. Rubens; H. Fendelman

[57] ABSTRACT

A microstrip hybrid ring coupler providing the same function as a conventional magic Tee in waveguide or a coaxial rat-race. The ring is comprised of four equal electrical length arcs between the input-output ports. The 180° phase shift is introduced in one of the four ring arcs by a tightly coupled parallel strip conductor which extends towards the interior of the ring and has an electrical length of $\lambda/4$ where $\lambda$ is the wavelength at the midband operating frequency of the coupler.

13 Claims, 2 Drawing Figures

Fig. 1
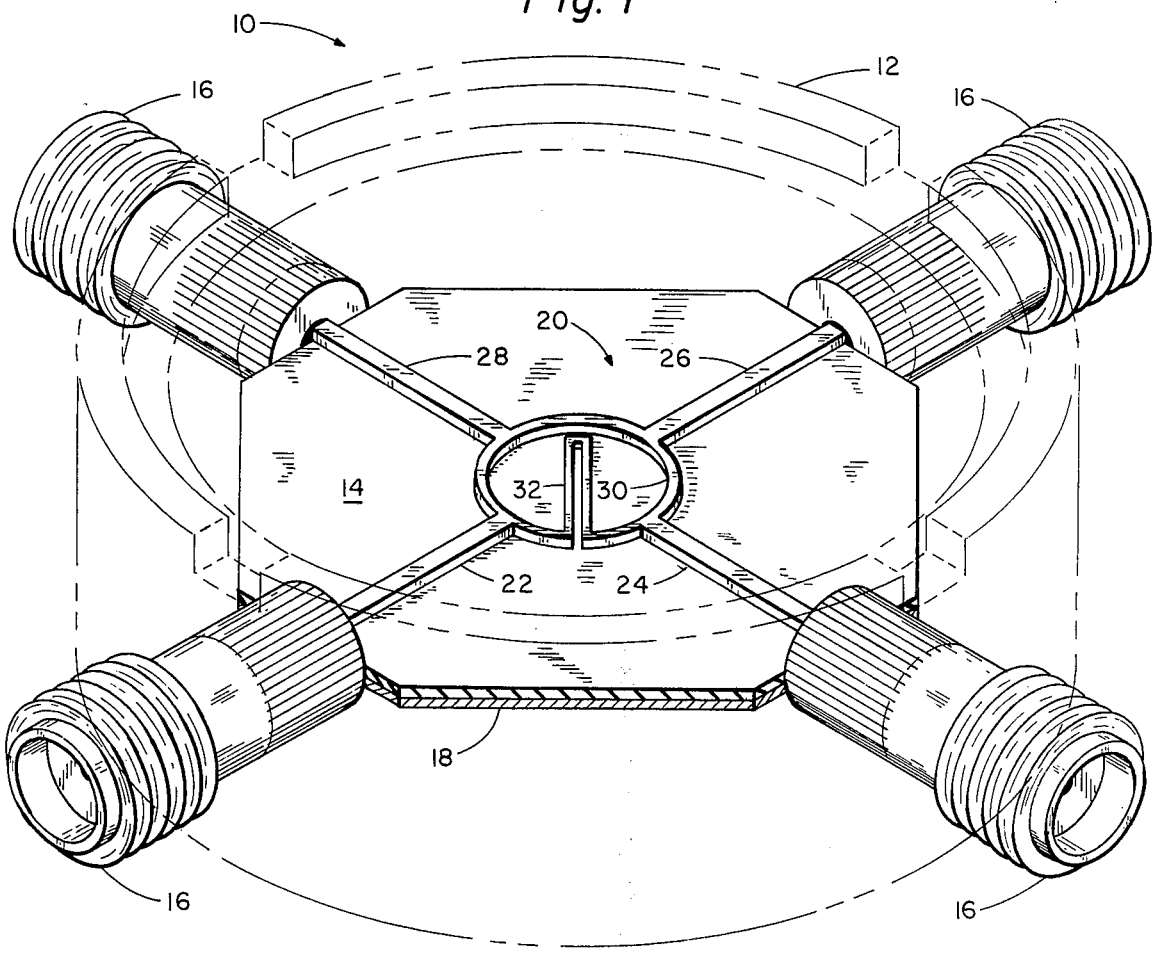
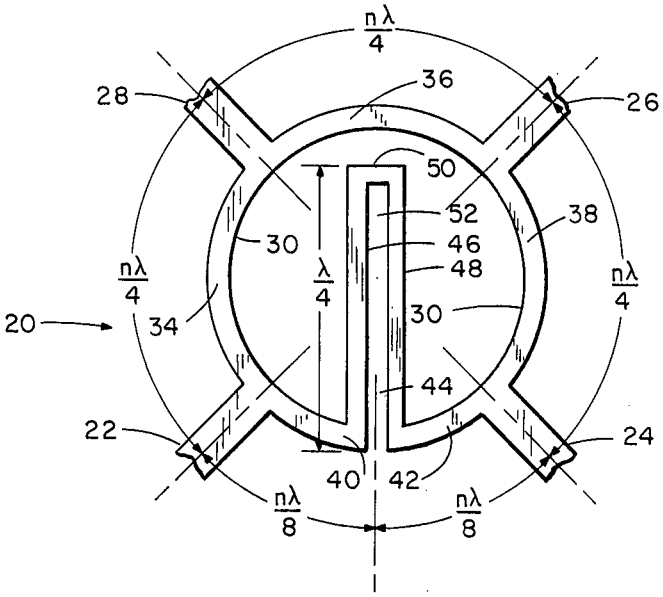
Fig. 2

MICROSTRIP HYBRID RING COUPLER

BACKGROUND OF THE INVENTION

A basic microwave circuit is the hybrid Tee comprising four terminals or arms so connected that when power is applied to any one arm, it divides approximately equally between the two arms adjacent to it but is completely isolated from the arm opposite from it. This type of circuit is commonly constructed in waveguide and/or coaxial line. A coaxial version is shown in U.S. Pat. No. 2,935,702. Another analogous device is the rat-race which has three of the four transmission lines between output ports equal to one-quarter wavelength and one line equal to three quarter wavelengths at midband. The isolation between any two opposite ports is infinite at midband because the two path lengths differ by exactly 180°. The isolation is degraded severely with a change in frequency, however, due to the change in relative path lengths. The useful bandwidth of such devices is about 2%.

A microstrip version of the ring coupler has been disclosed by John Reindel in U.S. Pat. No. 4,023,123. That device utilizes a 180° twisted pair of transmission lines and has a wider operational bandwidth than other prior art devices and is useful at EHF. The aforementioned reverse phased ring coupler, however, has the disadvantage that the manufacturing of the twisted pair of parallel conductors requires a skilled craftsman to position, space, and orient the twisted conductor pair under a microscope for each reverse phase ring produced.

SUMMARY OF THE INVENTION

The present invention relates to a microstrip coupler suitable for use in many complex microwave circuits such as balanced mixers, power dividers, comparators, etc. The coupler of the present invention is a completely planar device and has the distinct advantage of simplicity of manufacture utilizing conventional photoetching techniques and that lends itself readily to mass production.

The necessary 180° phase shift is introduced in one of four equal electrical length ring arcs by the use of a tightly coupled parallel strip quarter-wave section. This device thus retains the advantages of the reverse phase ring coupler disclosed in U.S. Pat. application Ser. No. 546,369 in that the four ring arcs are of equal electrical length, thereby rendering the device less frequency sensitive than the so-called rat-race which uses three quarter-wave length sections and one three-quarter wavelength section and yet obviates the manufacturing difficulties inherent in the reverse phase ring coupler described above. In addition to the fact that the tightly coupled parallel line section used in the present invention for introducing the requisite 180° phase shift is extremely simple to manufacture by conventional techniques, the tightly coupled parallel line section has the additional advantage of further rendering the device less frequency sensitive, i.e., permitting more broadband operation.

STATEMENT OF THE OBJECTS OF THE INVENTION

Accordingly, it is the primary object of the present invention to disclose a novel microstrip hybrid coupler that is easier to manufacture than the reverse phase hybrid coupler and still has a broader bandwidth than the conventional rat-race.

It is a further object of the present invention to disclose a microstrip hybrid ring coupler that is completely planar and, therefore, requires only conventional manufacturing techniques such as photoetching.

It is a still further object of the present invention to disclose a novel means for introducing a 180° phase reversal in a hybrid ring coupler.

It is another object of the present invention to disclose a hybrid ring coupler that has no space requirements other than for the ring itself due to the fact that the means for introducing the 180° phase shift is located in the interior of the ring.

Other objects, advantages and novel features of the invention will become apparent from the following detailed description of the invention when considered in conjunction with the accompanying drawings.

BRIEF DESCRIPTION OF THE DRAWINGS

FIG. 1 is a perspective view of the ring coupler of the present invention in an exemplary environment with coaxial connectors.

FIG. 2 is a plan view of the hybrid ring coupler of the present invention illustrating the 180° phase shifter and connector tabs.

DESCRIPTION OF THE PREFERRED EMBODIMENT

Referring to FIG. 1 there is illustrated the microstrip hybrid ring coupler 10 of the present invention. The hybrid ring 10 is mounted in a metallic housing 12 which supports the dielectric board 14 which may, for example, be a laminate or Teflon impregnated fiberboard. Coaxial connectors 16 may be press fit into the housing 12 and function as input-output terminals for connecting the device 10 to coaxial cables (not shown).

The dielectric board 14 is metal clad on both faces preferably with copper. The copper cladding on the bottom face forms the ground plane 18 for the microstrip circuit. The upper face of the dielectric 14 has a microstrip ring circuit 20 formed thereon by suitable techniques such as photoetching as is well known. The microstrip circuit includes four arms or connector tabs 22, 24, 26 and 28. These tabs are connected to the coaxial connector 16 inner conductor by suitable means such as soldering. The outer conductor of the coaxial connector 16 is soldered to the ground plane 18 (not shown). The remainder of the microstrip circuit is comprised of a ring section 30 and a 180° phase shift section 32.

Referring now to FIG. 2, the details of the microstrip circuit 20 will be described. The strip conductor ring 30 has three contiguous strip conductor sections 34, 36 and 38 between the tab connectors 22, 28, 26 and 24, respectively. The strip conductor sections 34, 36 and 38 each have an electrical length of $n\lambda/4$ where $\lambda$ is the wavelength corresponding to the midband operating frequency of the coupler and $n$ is an odd integer. The fourth strip conductor section of the ring 30 extends between the tab connectors 22 and 24 and is comprised of ring conductor sections 40 and 42 which are separated by a small gap 44. Disregarding temporarily the gap 44, the electrical distance between the tabs 22 and 24 along the strip conductor sections 40 and 42 is $n\lambda/4$. In the illustrated embodiment, the sections 40 and 42 are equal electrical length sections of approximately $n\lambda/8$, although it is to be understood that, notwithstanding the illustrated embodiment, sections 40 and 42 may be of unequal electrical length, the important consideration being that their total combined length is $n\lambda/4$.

The strip conductor section 32 is a tightly coupled parallel section and is comprised of a first conductor 46 electrically contiguous with the strip section 40 and a second strip section 48 electrically contiguous with the strip section 42. In accordance with the meaning of "tightly coupled section" and "parallel-coupled section" within the microwave electronics art and as used herein, the terms "tightly coupled section" and "parallel-coupled section" are limited to those microwave structures in which one portion of such section is electromagnetically coupled to another portion of such section. The parallel tightly coupled conductors 46 and 48 are connected by a strip conductor section 50 which is preferably made as narrow as possible. Strip conductors 46 and 48 are separated by a narrow gap 52 which extends into and merges with gap 44. The length of each of the strip conductors 46 and 48 is $\lambda/4$ measured as illustrated in FIG. 2.

In the illustrated embodiment the impedances of the strip conductor sections 34, 36, 38, 40 and 42 as well as strip conductor sections 46 and 48 is $Z_o\sqrt{2}$ where $Z_o$ is the impedance of each of the tab connectors 22, 24, 26 and 28. An exemplary value for the width of the gaps 44 and 52 is 0.001 inch for operation of the device at X-band.

The strip conductor section 32 is a phase shifter for introducing a 180° phase shift into signals propagating between the ring conductor sections 40 and 42. This 180° phase shift is believed to occur by reason of the fact that the signals propagating in the section 32 travel along the two quarter-wavelength strip sections 46 and 48, thus traveling a total distance of $\lambda/2$. It is further believed that the tight coupling between the strip conductors 46 and 48 across the narrow gap 52 and 44 enhances the operation of the device 10 by extending the bandwidth beyond that which would be achievable with uncoupled sections.

The device 10 thus far described is thus seen to be comprised of two pairs of diametrically oriented input-output tabs or arms with adjacent tabs being separated by a microstrip ring section of length $n\lambda/4$. One of the ring sections has interposed therein a means 32 for introducing a 180° phase shift. The operation of the device should, at this point, be readily apparent to those of ordinary skill in the art and is, briefly, as follows. Considering, for example, a microwave signal input at tab 26, the signal divides equally between sections 36 and 38 and appears as outputs at tabs 28 and 24. The tab 22 is completely isolated from the tab 26 due to the fact that any signal arriving at tab 22 via ring section 40, 42 is 180° out of phase of any signal arriving at tab 22 via ring section 34, the 180° phase shift having been introduced by the microstrip section 32. In short then, a signal inserted in any one arm of the coupler 10 will divide approximately equally between the two adjacent arms and will be isolated from its opposite arm.

The hybrid ring coupler of the present invention has the advantage of greater operational bandwidth than the conventional rat-race as well as the very important advantage of manufacturing simplicity due to the completely planar structure. The illustrated embodiment could be modified such that the phase shift section 32 extends outside the ring rather than inwards as where it may be more spatially beneficial to incorporate other microstrip circuit elements within the ring 20. The strip conductor impedances and gap spacings could also be modified in accordance with the desired operating characteristics such as frequency, bandwidth and degree of coupling.

Obviously many modifications and variations of the present invention are possible in the light of the above teachings. It is therefore to be understood that within the scope of the appended claims the invention may be practiced otherwise than as specifically described.

What is claimed is:

1. A microwave, microstrip hybrid ring coupler comprising:

a planar dielectric sheet having first and second opposing faces;

a ground plane conductor fixed to said dielectric sheet second face;

a generally circular shaped electrical strip conductor fixed to said dielectric sheet first face, said circular shaped strip conductor including first, second, third and fourth strip conductor sections, each said strip conductor section having an electrical length of approximately $n\lambda/4$ where $\lambda$ is the wavelength corresponding to the midband operating frequency of said coupler and where $n$ is an odd integer;

means for introducing a 180° phase shift into signals propagating in said fourth strip conductor section comprised of a tightly coupled section of strip conductors operatively connected to said fourth strip conductor section and being disposed entirely on said dielectric sheet first face;

first, second, third and fourth strip conductor tabs operatively coupled to said generally circular shaped electrical strip conductor ring at the junctures, respectively, of said first and second, said second and third, said third and fourth, and said fourth and first strip conductor sections, said tabs cooperating with said ground plane to form input-output ports.

2. The hybrid ring coupler of claim 1 wherein said tightly coupled section of strip conductors comprises first and second linear, parallel strip conductors, each having an electrical length of approximately $\lambda/4$.

3. The hybrid ring coupler of claim 2 wherein said first and second linear, parallel strip conductors extend to the interior of said circular shaped electrical strip conductor.

4. The hybrid ring coupler of claim 2 wherein said first and second linear, parallel strip conductors are connected at the ends thereof distal from said operative connection to said fourth strip conductor section by a narrow strip conductor line.

5. The hybrid ring coupler of claim 4 wherein said first and second linear, parallel strip conductors are separated by a narrow gap that extends into a gap in said fourth strip conductor section.

6. In a microwave, microstrip hybrid ring coupler including a dielectric sheet having a first face supporting a ground plane and a second face supporting a strip conductor circuit including a strip conductor ring having first, second, third and fourth equal electrical length sections each having a length of $n\lambda/4$ where $n$ is an odd integer and $\lambda$ is the wavelength corresponding to the midband operating frequency of the coupler, the strip conductor circuit further including first, second, third and fourth strip conductor tabs connected to said ring at the respective junctures of said four segments, the improvement comprising:

phase reversal means for introducing a 180° phase shift into the signal propagating in said fourth section comprising first and second parallel-coupled strip conductors connected to and extending from said fourth segment, said phase reversal means being disposed entirely on said dielectric sheet second face.

7. The coupler of claim 6 wherein the electrical length of each of said first and second parallel-coupled strip conductors is $\lambda/4$.

8. The coupler of claim 7 wherein said first and second parallel-coupled strip conductors extend into the interior of said strip conductor ring.

9. The coupler of claim 7 wherein said parallel-coupled strip conductors have a narrow gap therebetween that extends into a narrow gap in said fourth strip conductor section.

10. A microwave, microstrip hybrid ring coupler comprising:

a planar dielectric sheet having first and second opposing faces;

a ground plane conductor supported on said dielectric sheet second face;

first and second input-output strip conductor tabs supported on said dielectric sheet first face and defining a first common axis;

third and fourth input-output strip conductor tabs supported on said dielectric sheet first face and defining a second common axis orthogonally disposed relative to said first common axis;

a substantially circular strip conductor connected in common to each said input-output strip conductor and having a pair of ends defining a gap therein; and first and second parallel-coupled strip conductors for introducing a 180° phase reversal for signals propagating therethrough, each connected to one of said pair of ends, said first and second strip conductors being connected to each other and being entirely disposed on said dielectric sheet first face.

11. The coupler of claim 10 wherein said first and second parallel-coupled strip conductors each have an electrical length of $\lambda/4$ where $\lambda$ is the wavelength corresponding to the midband operating frequency of said coupler.

12. The coupler of claim 10 wherein said first and second parallel-coupled strip conductors extend to the interior of said substantially circular strip conductor.

13. The coupler of claim 10 wherein the electrical distance between adjacent strip conductor tabs along said substantially circular strip conductor is approximately $n\lambda/4$ where $n$ is an odd integer and $\lambda$ is the wavelength corresponding to the midband operating frequency of the coupler.

* * * * *